United States Patent [19]

Kimura

[11] Patent Number: 4,578,983

[45] Date of Patent: Apr. 1, 1986

[54] PRESS TYPE METHOD OF AND APPARATUS FOR REDUCING SLAB WIDTH

[75] Inventor: Tomoaki Kimura, Hitachi, Japan

[73] Assignee: Hitachi, Ltd., Tokyo, Japan

[21] Appl. No.: 556,944

[22] Filed: Dec. 1, 1983

[30] Foreign Application Priority Data

Dec. 1, 1982 [JP] Japan ..... 57-209367
Oct. 27, 1983 [JP] Japan ..... 58-201502

[51] Int. Cl.[4] ..... B21J 7/14

[52] U.S. Cl. ..... 72/407; 72/402; 72/76; 72/14

[58] Field of Search ..... 72/407, 402, 377, 76, 72/14, 408

[56] References Cited

U.S. PATENT DOCUMENTS

| | | | |
|---|---|---|---|
| 2,460,490 | 2/1949 | Cook | 72/76 |
| 3,379,047 | 4/1968 | Kralowetz | 72/377 |
| 3,495,427 | 2/1970 | Balamuth | 72/402 |
| 3,553,990 | 1/1971 | Suding et al. | 72/14 |
| 3,893,321 | 7/1975 | Braunwieser | 72/76 |
| 3,893,328 | 7/1975 | Blaimschein | 72/402 |
| 4,417,462 | 11/1983 | Palovcik | 72/402 |

FOREIGN PATENT DOCUMENTS

| | | | |
|---|---|---|---|
| 10363 | 1/1980 | Japan . | |
| 740372 | 2/1980 | U.S.S.R. | 72/377 |

*Primary Examiner*—Daniel C. Crane
*Attorney, Agent, or Firm*—Antonelli, Terry & Wands

[57] ABSTRACT

A press type method of reducing the slab width wherein a slab as a rolling stock is reduced in width before rolling comprises: employing as press tools a pair of opposed members at least one of which has an inclined press surface adapted to vibrate in the slab width direction; and moving the slab substantially continuously while continuing the vibration of the press tool. Also disclosed is an apparatus suitably employed for the above method. By the method and apparatus, the clearance between the press tools is reduced to make it possible to shorten the operating time as a whole. In addition, the pressed surfaces of the slab are made excellent in continuity thereby to permit improvements also in formability and production yield.

4 Claims, 10 Drawing Figures

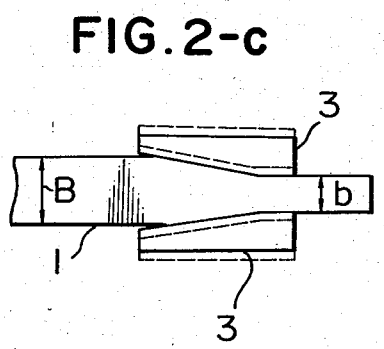
FIG. 2-c
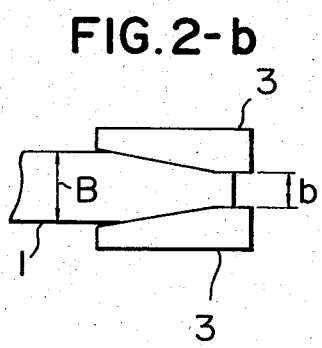
FIG. 2-b
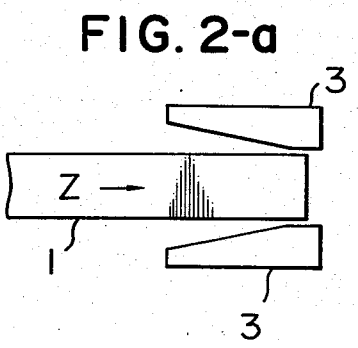
FIG. 2-a
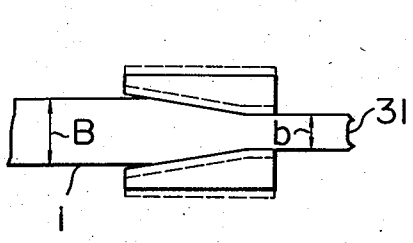
FIG. 5-c
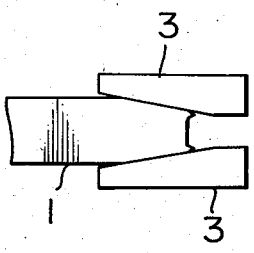
FIG. 5-b
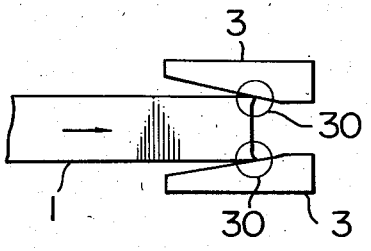
FIG. 5-a

PRESS TYPE METHOD OF AND APPARATUS FOR REDUCING SLAB WIDTH

BACKGROUND OF THE INVENTION

1. Field of the Invention

The present invention relates to a press type method and apparatus for reducing the slab width in which the width of a slab as a rolling stock is reduced before rolling, and more particularly, to a press type method of reducing the slab width improved in efficiency and formability.

2. Description of the Prior Art

These days, a flat stock for manufacturing a hot rolled strip, i.e., a slab is often obtained by means of a continuous casting machine. In this case, since it is difficult to directly vary the slab width by means of a continuous casting machine on the grounds of formability, there is a need for an extra process for regulating the slab obtained by a continuous casting machine to a slab width required according to rolling.

The dimensions of a stock or slab employed in hot rolling, for example, are usually required to fall between wide ranges: the slab thickness ranges from 30 to 300 mm; and the slab width from 900 to 2000 mm.

The slab thickness can be relatively easily regulated to a predetermined dimension required in rolling by employing such an equipment as a thickness-reducing rolling mill.

By a conventional slab width regulating means employing a vertical rolling mill, however, since the rolling roll diameter is 1200 to 2000 mm, it is difficult to apply pressing forces to the central portion of a slab. Consequently, if it is intended to regulate the slab width by a large margin, a projecting edge portion called "dog bone" may be formed at each of ends of the slab in its width direction, resulting in such an irregular shape that only the edges of the slab in its width direction are large in thickness. Therefore, in general, it is only possible to effectively perform a reduction in slab width within about 100 mm.

Because of this, a press type method of reducing the slab width has recently been devised that while a slab is fed longitudinally, compressive forces are applied to both edges thereof in the slab width direction by means of press tools each having a flat press surface thereby to reduce the width of the slab.

More specifically, as shown in the specification of Japanese Patent Laid-Open No. 10363/1980, for example, press tools adapted as if they were rolling rolls each having an infinite radius are employed to apply compressive forces over a wide range simultaneously, thereby to prevent the production of the above-mentioned "dog bones".

The conventional method, however, has problems of efficiency and formability, since the method employs a parallel press in which the press surfaces of press tools are parallel to each other. More specifically, in the case of such a parallel press, it is not possible to extremely increase the width of the slab side surface that can be pressed in a single operation owing to limitations of the required press forces. On the other hand, if the width of each press surface of the parallel press is reduced to decrease the required press force, there is a need for a remarkably large number of pressing operations. In other words, in case of employing such a parallel press, every time the slab is pressed the feed thereof is suspended. After pressing, the press tools are separated from each other to release the slab, and under this state, the slab is fed to the amount of corresponding to the press surface width. Therefore, even if the press surface width is set within a range where a proper press force can be applied, time is required for suspending and positioning the slab with the intermittent feed of the slab. In particular, when the slab is suspended, the feed speed must be gradually decreased, as a result the working efficiency is remarkably reduced. Moreover, since the feed of the slab cannot be started unless the press tools are opened more than the former width of the slab after pressing, a larger clearance is required between the press tools as the slab width regulation is larger in amount, which also consumes time.

In addition, since much time is required for the operation for reducing the slab width as described above, there are cases where the slab cools down during the operation to a temperature lower than a predetermined temperature required for processing. Moreover, in the above slab width reducing method employing the parallel press, there is a trouble which because the continuity of the boundary area between the surface portions pressed in successive operations is poor, an edge crack is caused in the thickness-reducing rolling operation carried out in the subsequent step.

SUMMARY OF THE INVENTION

Accordingly, a primary object of the invention is to provide a press type method of and an apparatus for reducing the slab width which make it possible to shorten the time required for pressing and improve both the pressing efficiency and the production yield of slab as well as contrive the improvement in formability of the slab surface pressed to reduce its width.

To this end, according to the invention, as press tools, a pair of opposing members are employed at least one of which has a press surface comprising an inclined surface such that the space defined between the same and a press surface of the other press tool gradually decreases in width in the slab feed direction and a parallel surface, substantially parallel to the slab direction, adapted to vibrate in the width direction of a slab, and while the vibration of the press tool is continued, the slab is moved substantially continuously. Moreover, the clearance between the press tools is reduced to make it possible to shorten the operating time as a whole. Thus, the continuity of the pressed surface of the slab is made excellent thereby to permit improvements also in formability and production yield.

The above and other objects, features and advantages of the invention will become clear from the following description of the preferred embodiments taken in conjunction with the accompanying drawings.

BRIEF DESCRIPTION OF THE DRAWINGS

FIGS. 2-*a* to 2-*c* illustrate the processing steps of the slab width reducing method in accordance with the invention, respectively;

FIGS. 5-*a* to 5-*c* in combination illustrate a comparison example of a slab width reducing method for reference.

DESCRIPTION OF THE PREFERRED EMBODIMENTS

Figure 1:
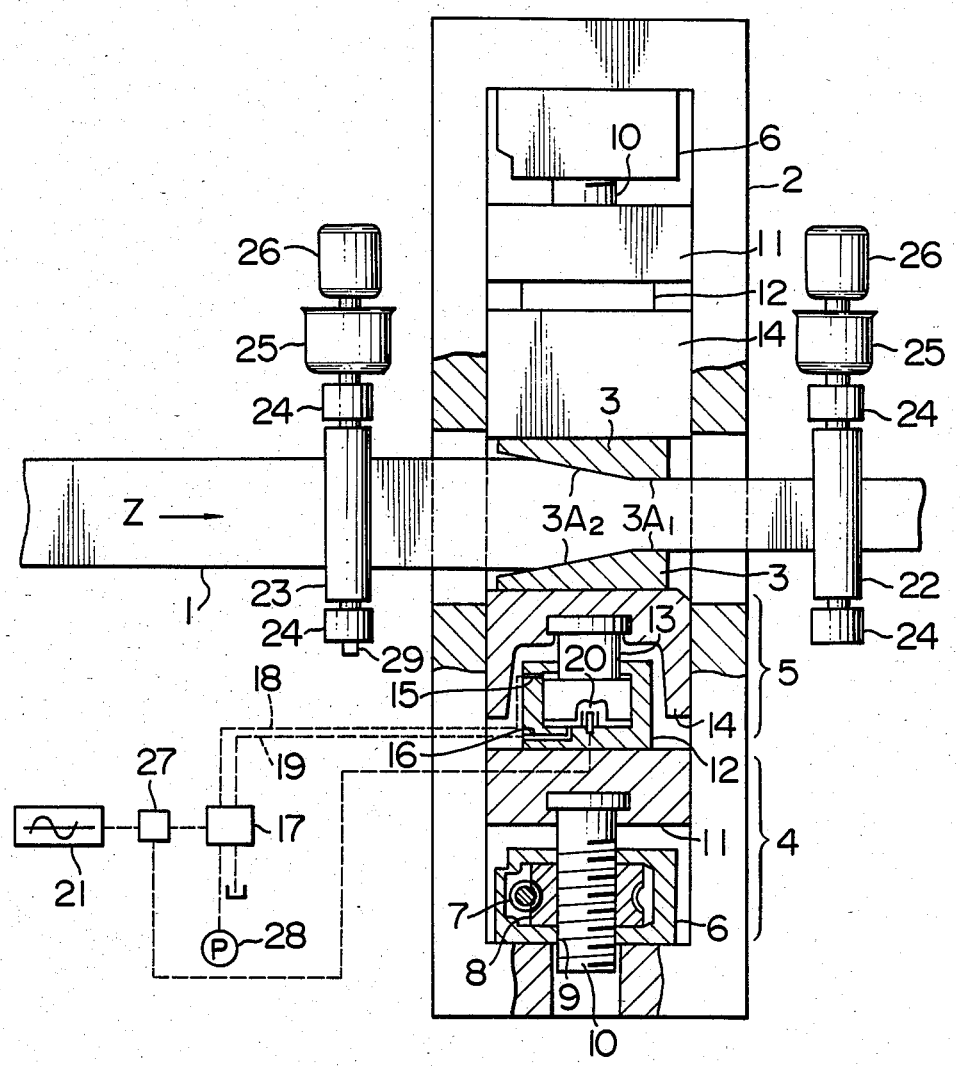
FIG. 1 is a partly-sectioned plan view of an embodiment of the press type slab width reducing apparatus in accordance with the invention.

Referring now to the drawings, as shown in FIG. 1, a pair of press tools 3 are vibratory supported at the slab receiving part in a fixed frame 2 which can receive a slab 1. More specifically, a width regulating means 4 and a vibrating means 5 are provided on either side of the fixed frame 2 (on both upper and lower sides of the fixed frame 2 as viewed in FIG. 1). Each press tool 3 is supported by the corresponding vibrating means 5. Each width regulating means 4 has, in a casing 6 mounted on the fixed frame 2, a worm 7 and a screw 10 that converts the width-regulating rotational input transmitted through a worm wheel 8 into a linear movement through a threaded portion 9 thereof. By the screw 10, a guide 11 can be moved in the width direction of the slab 1.

On the other hand, each vibrating means 5 has a cylinder 12 fixed to the corresponding guide 11, and a tool support plate 14 movably connected to the cylinder 12 through a piston 13. Each press tool 3 is supported by the corresponding tool support plate 14 as one unit. A servo valve 17 is connected to oil bores 15, 16 communicating with both end portions of the cylinder chamber of each cylinder 12 through pipings 18, 19, respectively. A controller 27 and a pump 28 are connected to the servo valve 17. The controller 27 is connected with a position detector 20 provided at one end of the cylinder 12 for detecting the position of the piston 13, together with a command device 21.

Pinch rollers 22, 23 are disposed on both sides of the fixed frame 2 in the slab feed direction, respectively. A reference numeral 24 denotes each of bearings for the pinch rollers 22, 23, while numerals 25 and 26 represent reduction gears and motors, respectively. The pinch roller 23 is provided with a revolution number detector 29 for detecting the number of revolutions of the roller, i.e., the feed amount of the slab 1.

A press surface of each press tool 3 is constituted by a parallel surface $3A_1$ which is substantially parallel to the slab feed direction Z, and an inclined surface $3A_2$ crossing the slab feed direction Z at an angle $\theta$. The press tools 3 are disposed facing each other with their parallel surfaces $3A_1$ on the downstream side and their inclined surfaces $3A_2$ on the upstream side as viewed in the slab feed direction.

The following is the description of the slab width reducing operation with reference to FIGS. 2-*a* to 2-*c*.

First of all, with the press tools 3 separated from each other with a large distance therebetween, the slab 1 is fed until its forward end is within the area between the parallel surfaces of the press tools 3, and the feed of the slab 1 is suspended (see FIG. 2-*a*). This slab feed amount is detected by the revolution number detector 29 provided on the pinch roller 23. Then, the press tools 3 are moved by the respective width-regulating means 4 in the slab width direction to initial pressing positions b, respectively, for effecting compression (see FIG. 2-*b*). After the slab 1 is compressed by a predetermined amount, the oil pressure produced by the pump 28 is supplied to each cylinder 12 through the servo valve 17 according to the signal from the command device 21 thereby to start to vibrate the hydraulic actuator, i.e., the vibrating means 5. As a result, the press tools 3 vibrate between the positions shown by solid lines and broken lines in FIG. 2-*c*, respectively. When the press tools 3 move from the positions shown by the solid lines to the positions shown by the broken lines, respectively, i.e., when the press tools 3 release the slab 1, it is fed in between the press tools 3, and when the press tools 3 move from the positions shown by the broken lines to the positions shown by the solid lines, respectively, the slab 1 is compressed into a predetermined width b. By repeating the compressing and releasing operations, the slab 1 can be reduced in width from a width B to a predetermined width b through compression.

Figure 3:
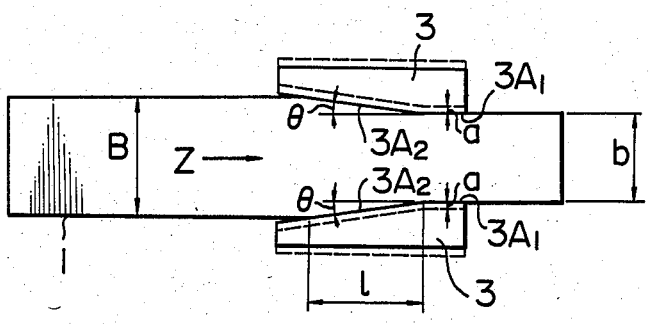
FIG. 3 shows how the slab feed speed in accordance with the invention is calculated.

The setting of an average feed speed v for the slab 1 will be explained hereinunder with reference to FIG. 3. In the drawing: the slab width before rolling is represented by a symbol B; the slab width after rolling by b; the amplitude of each press tool 3 by a; the effective press surface width by l; and the inclination angle of the inclined surface of each press tool 3 by $\theta$. It is to be noted that the number of vibrations of each press tool 3 is denoted by n.

Under the above-mentioned conditions, if the distance between positions where the slab 1 is fed when the press tools 3 vibrate once is represented by ds, $\tan\theta = a/ds$ is established. This relation can be converted into $ds = a/\tan\theta$. Therefore, the average feed speed v of the slab 1 is $v = n \cdot ds = n \cdot a/\tan\theta$.

Here, $\tan\theta = B\text{-}b/2l$; therefore, the average feed speed v is as follows:

$$v = \frac{2nal}{B - b}$$

Accordingly, if the average feed speed is calculated under the following conditions: for example, B-b=300 mm, a=1 mm, n=10/sec, and l=1500 mm, the average feed speed is as follows:

$$v = \frac{2 \times 10 \times 1 \times 1500}{150} = 200 \text{ mm/sec}$$

Thus, the reduction in width can be effected at this speed. This is about three times as high as that in the case of employing the conventional parallel press.

More specifically, in both the conventional parallel press and that in accordance with invention, the slab is intermittently fed. According to the invention, however, the feed speed is much higher than that of the conventional parallel press, and it is possible to feed the slab substantially continuously. In addition, in the conventional parallel press each slab feed amount must be strictly matched with the press surface width. In the case of the press tools in accordance with the invention, however, there is no need for such a strict slab feed as in the prior art. More specifically, even if there are some variations in each slab feed amount, since inclined surface provided on each press tool makes it possible to continuously compress the slab surfaces subjected to reduction in width, it is possible to prevent the production of any edge crack. Moreover, no time is required for suspending and positioning the slab being fed.

Figure 4:
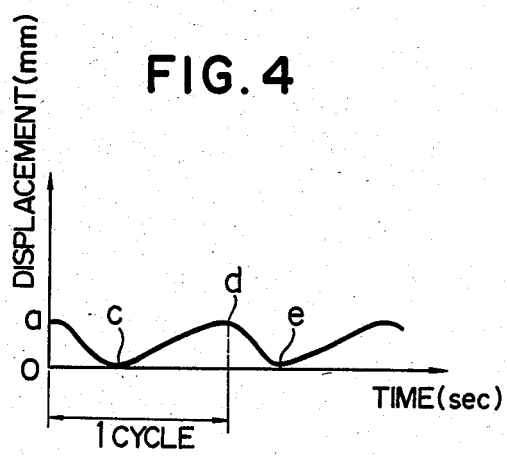
FIG. 4 shows the displacement-time curve representing the operation of press tools of the slab width reducing apparatus in accordance with the invention.

FIG. 4 shows a method for properly vibrating the press tools 3.

More specifically, when the slab 1 is compressed while the press tools 3 are vibrated, the signal from the command device 21 for specifying the vibration mode preferably has a curve such as shown in FIG. 4. In the drawing, the section of the curve between points c and d represents the compression time of the slab, while the section between points d and e indicates the release time of the slab for one cycle of vibration. A large reaction force is required for the section between the points c and d, since the slab 1 is compressed during the period; hence, the section between the points c and d is set to be long. On the other hand, the section between the points d and e is set to be short, since no compressive load is required during this period. Thus, since the amplitude of vibration a is the same during both compression and release, the speed of the press tool is higher in the direction for releasing the slab than in the direction for compressing the slab.

If such a method is carried out, the operation for reducing the slab width is efficiently conducted, and the operating time can be effectively shortened.

As described above, according to the method of the embodiment, the time necessary for reducing the width of the slab 1 can be decreased to about $\frac{1}{3}$ of that conventionally required. In addition, it is possible to provide a rolling stock excellent in quality, having pressed surfaces finished continuously as well as uniformly.

Moreover, unlike the case where the slab is directly pressed by employing inclined surfaces, there is no possibility of production of any "horn" or "recess" at the forward end of the slab. More specifically, in the case where the slab 1 is fed in between the press tools 3 standing by while being close to each other and under this state the press tools 3 are vibrated to effect the reduction of the slab width as shown in FIGS. 5-*a* to 5-*c*, there are needs for improvement of the following disadvantages which are encountered:

(1) When the slab 1 is fed in between the press tools 3 on standby, the edges of the slab 1 abut on the press tools 3 to produce "horns" 30 with ease, respectively, (see FIG. 5-*a*).

(2) When the slab 1 is first compressed by the inclined surfaces of the press tools 3, "a recess" 31 is produced with ease in the forward end surface of the slab 1 by the subsequent compression (see FIGS. 5-*b* and 5-*c*).

(3) Owing to the difference in friction coefficient between the slab 1 and the press tools 3, the slab 1 may frequently slip, resulting in a failure in compression of the forward end portion of the slab 1.

On the other hand, according to the above embodiment, after the slab forward end portion is positioned within the area between the parallel surfaces $3A_1$ of the press tools at the start of the compression by pressing, the compression is effected by pressing, and subsequently, the reduction in width is effected over the entire length of the slab by the inclined surfaces $3A_2$ and the parallel surfaces $3A_1$ of the press tools through a predetermined vibrational movement of the press tools. Thus, it is possible to reduce the slab width uniformly without the possibility of production of any "horn" or "recess" at the slab forward end portion.

It is to be noted that although in the above embodiment both the press tools 3 are vibrated, this is not exclusive and such an arrangement may be employed that one of the press tools is fixed and only the other is vibrated. In this case, an inclined surface is provided on the press tool which is vibrated, and a flat surface is provided on the fixed press tool.

In addition, as the vibrating means 5 for vibrating each press tool 3, it is possible to employ a mechanical action by means of cam or crank, besides the hydraulic actuator in the above-described embodiment.

Moreover, although in the above embodiment the vibrating means 5 is mounted on each width regulating means 4, it is possible to mount the width regulating means 4 on each vibrating means 5 and mount the press tool 3 on each width regulating means 4. More specifically, each width regulating means 4 and the corresponding press tool 3 may be vibrated as one unit to reduce the slab width.

Furthermore, the linear compressing surface of each press tool 3 as illustrated in the above embodiment is not exclusive and the compressing surface may be curved. In particular, the boundary portion between the part that effects the reduction of the slab width and the part that is not in charge of the reduction, i.e., the boundary portion between the inclined surface $3A_2$ and the parallel surface $3A_1$ is preferably formed into a smooth round shape.

Figure 6:
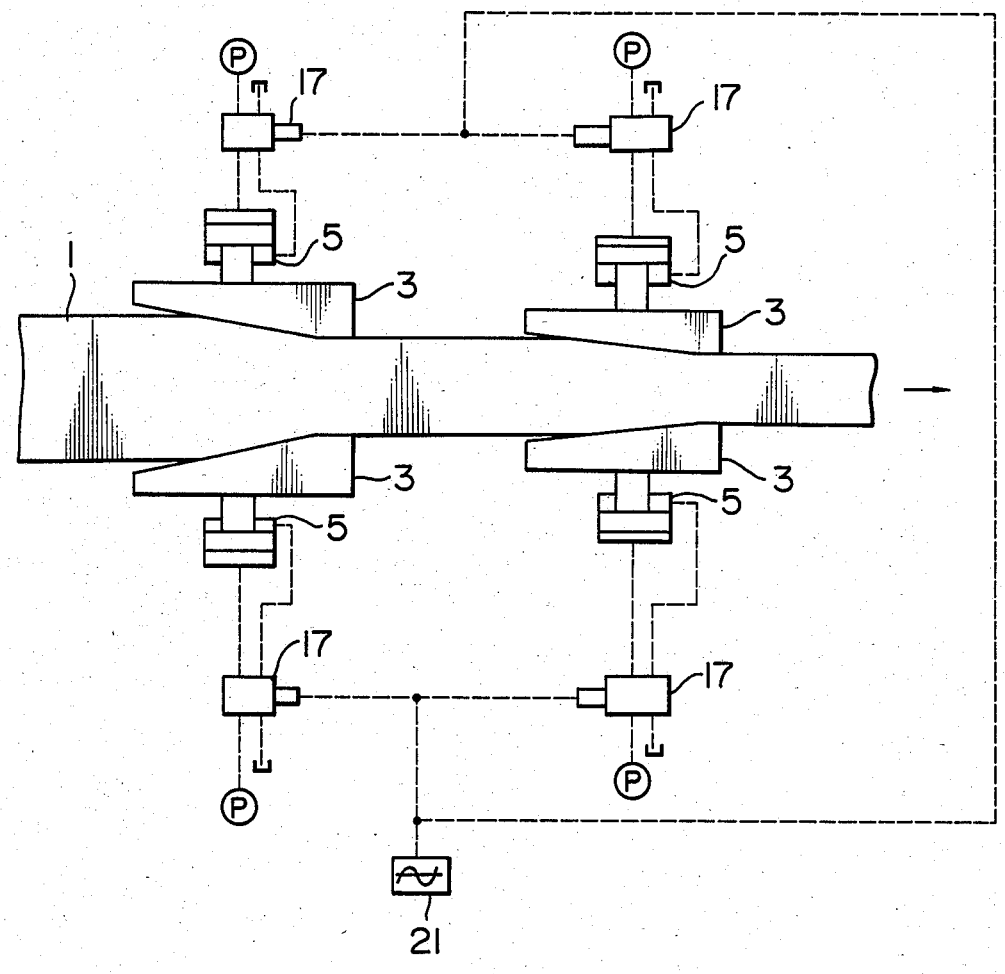
FIG. 6 illustrates an example of application of the invention.

It is to be noted that although the slab width reducing operation is conducted in one stage in the above-described embodiment, the operation may be carried out in a plurality of stages, i.e., in a tandem manner as shown in FIG. 6. In such a case, it is only necessary to vibrate the press tools 3 at each stage according to the commands from the mutual command device 21.

By this method, as a matter of course, the advantages similar to those in the above embodiment can be offered, and in addition, it is possible to integrally multiply the speed in proportion to the number of stages.

As has been described through the above embodiments, according to the invention, the press tools having inclined surfaces are employed to move the slab substantially continuously while the press tools are continuously vibrated. Therefore, the feed speed is higher than that in the conventional parallel press, and a smaller clearance is required between the press tools, so that the operating efficiency improves correspondingly: for example, the operating time can be reduced to about $\frac{1}{3}$ of that required conventionally. Moreover, the continuous width-reducing operation makes it possible to smooth the formed surfaces of the slab, thereby permitting an improvement in quality also.

Although the invention has been described through specific terms, it is to be noted here that the described embodiments are not exclusive and various changes and modifications may be imparted thereto without departing from the scope of the invention which is limited solely by the appended claims.

What is claimed is:

1. A press type apparatus for reducing the width of a slab comprising:

a feed line for advancing a slab;

a pair of press tools disposed on both width-wise sides of the slab feed line so that their press surfaces for compressing the slab are opposed to each other, at least one of said press surfaces having a parallel surface that is substantially parallel to the feed line and an inclined surface having a predetermined angle with respect to the feed line;

a width regulating means for regulating the position of said press tool having the inclined surface in the slab width direction to initially press a leading end portion of the slab to a predetermined slab width with said parallel surface;

a vibrating means for vibrating said press tool having the inclined surface; and a control means for actuating said width regulating means to initially press the leading end portion of the slab to the predetermined slab width after detecting that the leading end portion of said slab has been disposed between the parallel surfaces of said press tools, and for actuating said vibrating means after said initial pressing is effected.

2. A press type apparatus for reducing the slab width according to claim 1, wherein said press tools are constructed such that at least one of said press tools has a press surface constituted by a parallel surface, substantially parallel to the slab feed line, defined by the forward portion of said press surface as viewed in the slab feed direction and an inclined surface defined by the backward portion of said press surface such that the space defined between the same and a press surface of the other press tool gradually decreases in width in the slab feed direction.

3. A press type apparatus for reducing the slab width according to claim 2, wherein the press surface of said press tool having the inclined surface has a smooth round boundary portion between said parallel surface and inclined surface.

4. A method of reducing the width of a slab by compressing the slab by means of a pair of press tools opposed to each other with at least one of the press tools including an inclined press surface inclined with respect to a slab feed direction and a parallel press surface substantially parallel with respect to the slab direction, comprising:

disposing a leading end portion of said slab between said press tools adjacent said at least one parallel press surface with said press tools separated from each other a distance greater than the width of the leading end portion of said slab, said distance being measured between said parallel surface of one press tool and the opposed surface of the other press tool;

initially pressing the disposed leading end portion of said slab to a predetermined width with said parallel press surface while said slab is stationary;

subsequently vibrating said press tool in the slab width direction; and advancing said slab in the feed direction between said press tools substantially continuously while said press tool is vibrating, whereby said slab is reduced in its width to a predetermined width over the whole length thereof.

* * * * *